United States Patent [19]

Walton, Jr.

[11] 4,368,471

[45] Jan. 11, 1983

[54] ANTENNA ICE REMOVAL AND PREVENTION APPARATUS

[76] Inventor: William B. Walton, Jr., 5436 Pinto, Rubidoux, Calif. 92509

[21] Appl. No.: 177,249

[22] Filed: Aug. 11, 1980

[51] Int. Cl.[3] ..... H01Q 1/02

[52] U.S. Cl. ..... 343/704; 343/840

[58] Field of Search ..... 343/704, 840; 92/2.04; 244/207, 134 B

[56] References Cited

U.S. PATENT DOCUMENTS 4,126,864 11/1978 Hopkins ..... 343/704

4,259,671 3/1981 Levin ..... 343/704

FOREIGN PATENT DOCUMENTS 2035211 1/1972 Fed. Rep. of Germany ..... 343/704

*Primary Examiner*—David K. Moore

*Attorney, Agent, or Firm*—Boniard I. Brown

[57] ABSTRACT

Apparatus for cooperation with an associated antenna for prevention of the formation of ice and/or removal of accumulated ice which includes apparatus for enclosing a substantial portion of the convex face of the antenna to define a plenum chamber and apparatus for burning a fuel to create heat. The apparatus for burning is disposed at the plenum chamber. Apparatus is also provided for distributing heated air to the geometric extent of the plenum chamber. The associated antenna may be generally dish shaped and may have a truss supporting frame. The apparatus for enclosing may include a plurality of discrete panels dimensioned and configured for engagement with the truss work of the associated antenna. The invention also includes a bracket that includes a generally U-shaped bracket and a generally planar member.

3 Claims, 4 Drawing Figures

ANTENNA ICE REMOVAL AND PREVENTION APPARATUS

BACKGROUND OF THE INVENTION

The apparatus in accordance with the invention relates to removal of ice which has accumulated on antennas as well as for preventing the formation of ice on antennas. The apparatus has particular application to large earth station antennas for communications applications utilizing satellites. In a typical antenna installation there may be two dish shaped antennas having a diameter of approximately ten meters. Such antennas may cooperate with satellites and may have, for example, approximately 144 voice and data circuits. A problem with the utilization of such antennas is that signal distortions occur when ice accumulates on such antennas. The formation of ice may also reduce the strength of the signal which is taken from the antenna. The difficulty of preventing ice formation is particularly acute because of the large surface area of the antennas (e.g. the area may be about 845 square feet) and such antennas are typically installed at high elevations where the climate may be most conducive to the formation of ice.

The prior art apparatus for prevention and removal of ice formations includes the use of electrical resistance tape or pad assemblies. Such apparatus has been found to be expensive to purchase, to install, and to operate. Typically such tapes or pads have been installed on the lower extremity of the antenna. This has tended to cause distortion of the signal or signals received by the antenna. Hot air heating systems have also been used in which the lower half of the antenna was enclosed and warm air was pumped by a tube into the bottom of the antenna and then passed out of the top of the enclosure. These known apparatus have not been wholly satisfactory either because of the cost of initial aquisition, installation, or operation, or because they did not produce the desired result. Some antennas which do not have any ice control apparatus and also some antennas which were nominally provided with such apparatus have experienced a significant amount of down time because of such ice formation.

It is a primary object of the invention to provide apparatus which will reduce the down time of the antenna with which it cooperates.

It is another object of the invention to provide apparatus which will avoid signal loss or distortion due to ice formation.

It is another object of the invention to provide apparatus which will not inherently result in signal distortion due to the electo-magnetic characteristics of the apparatus.

It is another object of the invention to provide apparatus which will have a small power consumption and thus low operating cost.

It is another object of the invention to provide apparatus which will improve the aesthetic appearance of an earth station antenna.

It is still another object of the invention to provide apparatus which will avoid unnecessary operation of the ice control apparatus in accordance with the invention.

It is yet another object of the invention to provide apparatus which may be installed without interruption of the operation of the antenna with which it cooperates.

Yet another object of the invention is to provide apparatus which will be capable of burning a wide variety of fuels so that the apparatus may function with a fuel which is most readily available in the region in which the apparatus will function.

SUMMARY OF THE INVENTION

The foregoing objects and other objects and advantages which shall become apparent from the detailed description of the preferred embodiment are attained in an apparatus for cooperation with an associated antenna for prevention of the formation of ice and/or removal of accumulated ice which includes means for enclosing the convex face of the antenna to define a plenum chamber and means for burning a fuel to create heat. The means for burning may be disposed within the plenum chamber. The apparatus may further include means for distributing air heated (by the means for burning) to the geometric extent of the plenum chamber.

The associated antenna may be generally dish shaped and may have a truss supporting frame. The means for enclosing may include a plurality of discrete panels dimensioned and configured for engagement with the truss work of the associated antenna. At least some of the discrete panels are mounted by brackets cooperating with the truss work. The brackets may include at least a first generally planar member. The means for distributing air may include a generally Y-shaped duct disposed within the plenum.

BRIEF DESCRIPTION OF THE ACCOMPANYING DRAWING

DESCRIPTION OF THE PREFERRED EMBODIMENT

Figure 1:
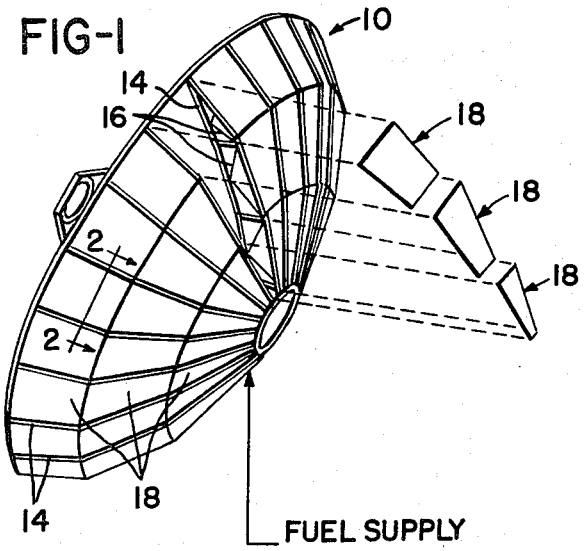
FIG. 1 is partially schematic perspective view of an antenna in accordance with one form of the invention illustrating, in part, the manner of cooperation between the truss work of the antenna and various insulating panels.
Figure 3:
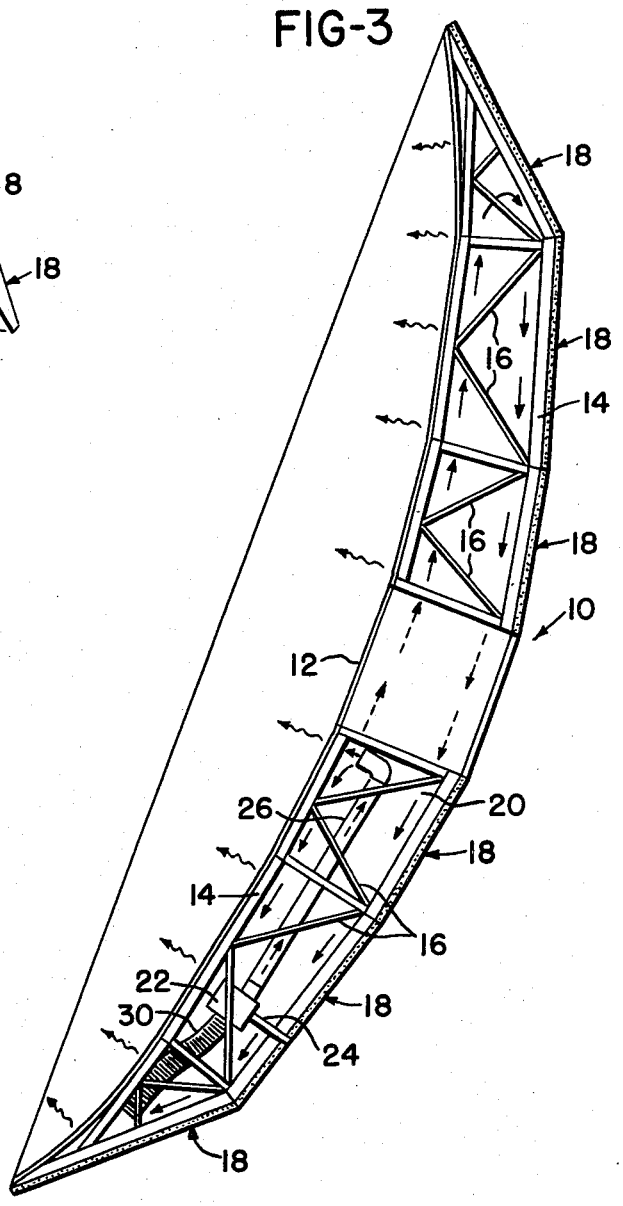
FIG. 3 is a sectional view taken through a generally vertical plane of the dish shaped antenna illustrated in FIG. 1.
Figure 2:
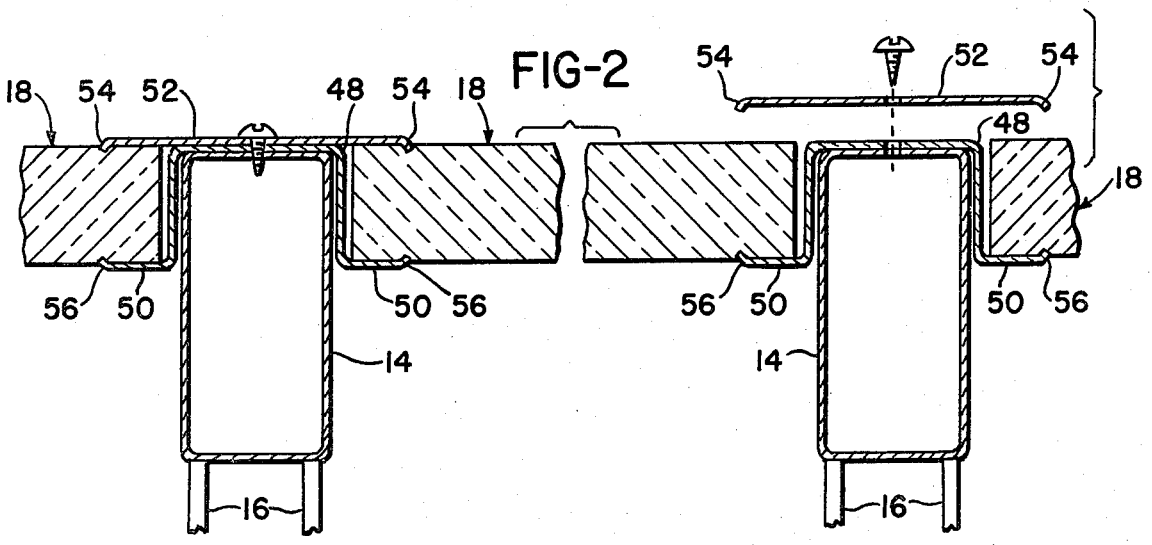
FIG. 2 is a broken away sectional view to an enlarged scale illustrating the manner of mounting the insulating panels on the truss work in greater detail.
Figure 4:
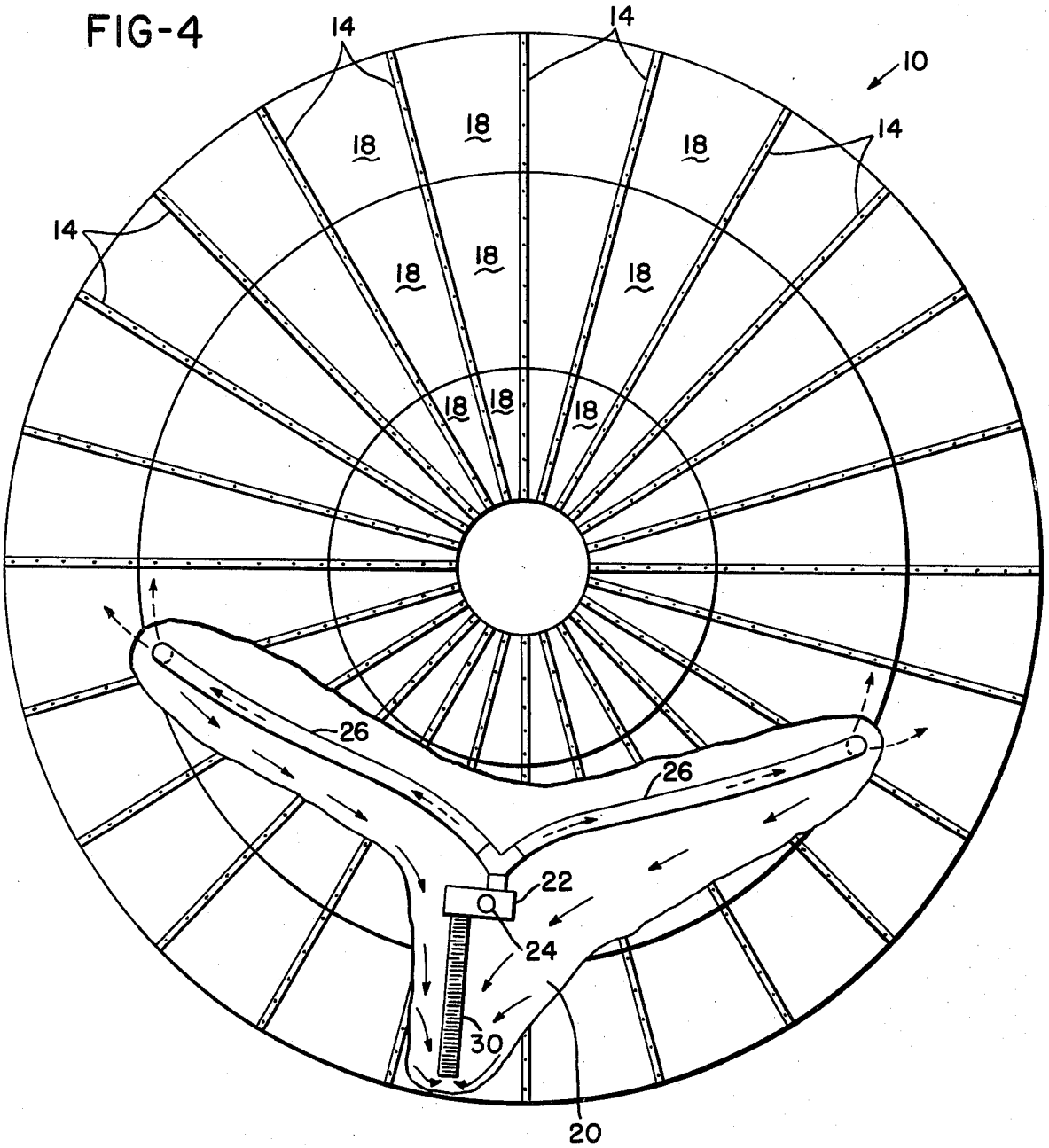
FIG. 4 is a rear elevational view of the antenna shown in FIG. 1.

Referring now to FIGS. 1, 3 and 4 there is shown a dish shaped antenna assembly 10 having a concave face or front surface 12 carried on a plurality of frame members 14 which are interconnected by oblique members 16 to form truss work. Carried on the truss work are a plurality of insulating panels which are generally identified by the numeral 18. The geometry of the individual panels 18 will vary obviously so that each panel will cooperate with the exterior portions of the truss work to form a substantially fluid tight connection therebetween. One example of such cooperation is illustrated in FIG. 2 and that construction will be described in greater detail hereafter. The positioning of the panels 18 on the truss work defined by elements 14 and 16 defines a plenum chamber 20 which is intermediate of the front face 12 and the various panels 18. Carried within the plenum 20 is a furnace or heater 22. In various forms of the invention the heater may be adapted for burning propane, natural gas, or diesel fuel. A gas fired heater or furnace 22 which is suitable is manufactured by Modene Manufacturing Company, Rescine, Wis. Another suitable heater is manufactured by National Riverside Co., Uplands, Ca. The furnace 22 will be provided with a small air inlet 24 which extends from the furnace 22 to the rear of the antenna assembly 10. It is preferred that the air inlet 24 while receiving outside air for combustion be made as small as possible to minimize the requirement for heating and hence produce the maximum amount of heat with the least amount of fuel. The furnace assembly 22 will be understood to include a fan (not shown separately) for forcing air out of an outlet duct 26. As will best be seen in FIG. 4, the outlet duct 26 has a generally Y-shape which provides for greater distribution of the air heated by the furnace 22. The outlet duct 26 extends to a generally central location with respect to the plenum 20. Air leaving the outlet duct 26 will tend to flow over the rear side of the front face 12 of the antenna assembly 10. After circulating within the plenum 20, it will then continue to the inlet duct 30 which supplies air to the heater 22. The heater 22 includes a sensor for operation of the heater. The sensor monitors both moisture and temperature within the plenum 20. When the sensor perceives the presence of moisture in the air within the plenum 20 and a temperature below a predetermined value, the furnace 22 is caused to start. Ordinarily the furnace 22 will also include a timer which turns off the system after a predetermined period of operation. The sensor will cause the furnace to restart if the requisite moisture and temperature conditions continue to exist. A sensor of the general type contemplated by the invention is manufactured by M.P.S. Co. of New Carlisle, Ind. The sensor is identified by the number AS-6 sensor and the trademark "EASY-HEAT".

Referring now to FIG. 2 there are shown two frame members 14 which are disposed in generally parallel relationship. An insulating panel 18 is disposed on a generally U-shaped bracket 48 which is dimensioned and configured for engagement with the frame member 14. The bracket 48 further includes flanged surfaces 50 which engage one side of each insulating panel 18. A generally planar member 52 having downwardly extending tip portions 54 engages each insulating member 18 as well as the generally U-shaped bracket 48. In a similar manner the flanged surfaces 50 of the generally U-shaped bracket 48 include upwardly extending tip portions 56 which also assist in gripping the insulating panels 18. The insulating panels 18 may, in some forms of the invention, be laminated. In various forms of the invention they may be manufactured of an insulating plastic material such as styrofoam.

It has been found that in operation the apparatus in accordance with the invention may be operated at low cost and provide a highly effective ice control system.

The invention has been described with reference to its illustrated preferred embodiment. Persons skilled in the art of constructing ice control apparatus and antannae may, upon exposure to the teachings herein, conceive variations in the mechanical development of the components therein. Such variations are deemed to be encompassed by the disclosure, the invention being delimited only by the appended claims.

The inventor claims:

1. Apparatus for cooperation with an associated antenna, which is generally dish shaped and has a truss supporting frame, for prevention of the formation of ice and/or removal of accumulated ice which comprises:

means for enclosing substantially the entire convex face of the antenna to define a plenum chamber, said means for enclosing including a plurality of discrete panels dimensioned and configured for engagement with the truss supporting frame of the associated antenna;

means for burning a fuel to create heat, said means for burning being disposed within said plenum chamber;

means for distributing air heated by said means for burning to the geometric extent of the associated antenna;

at least some of said discrete panels being mounted by brackets cooperating with the truss supporting frame, said brackets including at least a generally U-shaped bracket and a generally planar bracket member, said generally U-shaped bracket further including flange surfaces extending in a direction which is generally parallel to said generally planar bracket member.

2. The apparatus as described in claim 1, wherein:

said generally planar bracket member and said flange surfaces each include tip portions extending toward the panel with which each cooperates.

3. The apparatus as described in claims 1 or 2, wherein:

said means for distributing air includes a generally Y-shaped duct disposed within said plenum.

* * * * *